US010177486B2

(12) United States Patent
Kobayashi et al.

(10) Patent No.: US 10,177,486 B2
(45) Date of Patent: Jan. 8, 2019

(54) CONNECTOR

(71) Applicant: Yazaki Corporation, Minato-ku, Tokyo (JP)

(72) Inventors: Tooru Kobayashi, Makinohara (JP); Hisaya Shibata, Makinohara (JP)

(73) Assignee: Yazaki Corporation, Minato-ku, Tokyo (JP)

( * ) Notice: Subject to any disclaimer, the term of this patent is extended or adjusted under 35 U.S.C. 154(b) by 0 days.

(21) Appl. No.: 15/977,200

(22) Filed: May 11, 2018

(65) Prior Publication Data

US 2018/0342828 A1 Nov. 29, 2018

(30) Foreign Application Priority Data

May 25, 2017 (JP) ..... 2017-103958

(51) Int. Cl.
*H01R 13/52* (2006.01)
*H01R 13/422* (2006.01)

(52) U.S. Cl.
CPC ..... *H01R 13/521* (2013.01); *H01R 13/4223* (2013.01)

(58) Field of Classification Search
CPC ..... H01R 13/5221; H01R 13/5208; H01R 13/5213; H01R 13/443; H01R 13/5216
USPC ..... 439/274, 275, 587, 588, 148, 936
See application file for complete search history.

(56) References Cited

U.S. PATENT DOCUMENTS

| | | | | |
|---|---|---|---|---|
| 5,645,451 | A | 7/1997 | Ohsumi et al. | |
| 6,203,348 | B1 * | 3/2001 | Fukuda | H01R 13/5208 439/271 |
| 6,521,160 | B2 * | 2/2003 | Suzuki | H01R 13/5205 264/267 |
| 7,922,530 | B2 * | 4/2011 | Chazottes | H01R 13/5208 439/587 |
| 8,215,988 | B2 * | 7/2012 | Ooki | H01R 13/5208 439/599 |
| 8,721,373 | B2 * | 5/2014 | Suzuki | H01R 13/506 439/589 |
| 9,774,127 | B2 | 9/2017 | Yamaki et al. | |
| 9,923,298 | B2 * | 3/2018 | Hashimoto | H01R 13/516 |
| 9,960,523 | B2 * | 5/2018 | Kobayashi | H01R 13/521 |

(Continued)

FOREIGN PATENT DOCUMENTS

| | | | |
|---|---|---|---|
| JP | H07-282892 | A | 10/1995 |
| JP | 2008-084671 | A | 4/2008 |

(Continued)

*Primary Examiner* — Phuong Chi T Nguyen
(74) *Attorney, Agent, or Firm* — Banner & Witcoff, Ltd.

(57) ABSTRACT

A connector includes a terminal, a housing, a waterproofing member and a waterproofing member cover. The waterproofing member includes a cylindrical sealing portion in which an insertion hole for the terminal is formed, and a guide portion disposed at least on a rear side in a terminal insertion direction in the insertion hole of the sealing portion and having a tapered shape so as to guide the terminal toward the insertion hole. The waterproofing member includes an elastically-deformable thin portion in a periphery of the sealing portion so that weight generated when the terminal guided to the insertion hole by the guide portion expands the insertion hole is larger than weight necessary for moving the sealing portion in a direction perpendicular to the terminal insertion direction.

3 Claims, 9 Drawing Sheets

(56) References Cited

U.S. PATENT DOCUMENTS

| | | | | |
|---|---|---|---|---|
| 10,033,131 | B2 * | 7/2018 | Uchiyama ..... | H01R 13/5202 |
| 2016/0352039 | A1 | 12/2016 | Yamaki et al. | |

FOREIGN PATENT DOCUMENTS

| | | | |
|---|---|---|---|
| JP | 2012-243739 | A | 12/2012 |
| JP | 2014-002978 | A | 1/2014 |
| JP | 2014-220058 | A | 11/2014 |
| JP | 2016-225045 | A | 12/2016 |

* cited by examiner

CONNECTOR

CROSS REFERENCE TO RELATED APPLICATIONS

This application is based on Japanese Patent Application (No. 2017-103958) filed on May 25, 2017, the contents of which are incorporated herein by way of reference.

BACKGROUND

The present invention relates to a connector which is provided with a waterproofing member.

There is known a connector which includes a housing provided with a terminal accommodating chamber which stores a terminal connected to an end of an electric wire, a waterproofing member which is provided on a rear side of the housing to seal a gap between the electric wire and the housing, and a waterproofing member cover which is used to assemble the waterproofing member and the housing (for example, see JP-A-7-282892, JP-A-2008-84671, JP-A-2012-243739, JP-A-2014-2978, JP-A-2014-220058, and JP-A-2016-225045).

SUMMARY

It is one advantageous aspect of the present invention to provide a connector with which a terminal can be smoothly mounted without damage on the waterproofing member so as to improve reliability of a sealing performance.

According to one aspect of the invention, there is provide a connector including:

a terminal connected to an end of an electric wire;

a housing including a terminal accommodating chamber to which the terminal is inserted from a rear side;

a waterproofing member including an insertion hole through which the terminal passes, and mounted on a rear side of the housing to seal a gap between the housing and the electric wire extending from the terminal passed through the insertion hole; and a waterproofing member cover including a through hole through which the terminal passes, holding the waterproofing member in the housing, and configured to guide the terminal to be inserted to the through hole toward the terminal accommodating chamber, wherein the waterproofing member includes a cylindrical sealing portion in which the insertion hole is formed, and a guide portion disposed at least on a rear side in a terminal insertion direction in the insertion hole of the sealing portion and having a tapered shape so as to guide the terminal toward the insertion hole, and the waterproofing member includes an elastically-deformable thin portion in a periphery of the sealing portion so that weight generated when the terminal guided to the insertion hole by the guide portion expands the insertion hole is larger than weight necessary for moving the sealing portion in a direction perpendicular to the terminal insertion direction.

The connector may be configured such that:

the housing includes a cylindrical wall which forms a storage space storing the waterproofing member and the waterproofing member cover, and the waterproofing member cover is configured to be moved, from a temporary locking position where the waterproofing member is mounted in the storage space so as to be prevented from being pulled off without being compressed and deformed in a mounting direction, to a final locking position where the waterproofing member is compressed and deformed in the mounting direction.

The thin portion may be disposed near a rear side of the terminal insertion direction in the sealing portion.

BRIEF DESCRIPTION OF DRAWINGS

FIGS. 2A and 2B are views for describing a mat seal, in which FIG. 2A is a perspective view of the mat seal, and FIG. 2B is a front view of the mat seal;

FIGS. 6A and 6B are views for describing a structure of a terminal, in which FIG. 6A is a perspective view of the terminal, and FIG. 6B is a front view of the terminal;

FIGS. 8A and 8B are views illustrating a state of the mat seal when the terminal is inserted into an insertion hole, in which FIGS. 8A and 8B are cross-sectional views illustrating the mat seal and the mat seal cover respectively; and FIGS. 9A and 9B are views for describing a connector which is provided with a mat seal of the related art, in which FIG. 9A is a cross-sectional view illustrating a part of the connector in which the terminal is stored, and FIG. 9B is a cross-sectional view of the mat seal in which the terminal is inserted into the insertion hole and the mat seal cover.

DETAILED DESCRIPTION OF EXEMPLIFIED EMBODIMENTS

Figure 9A:
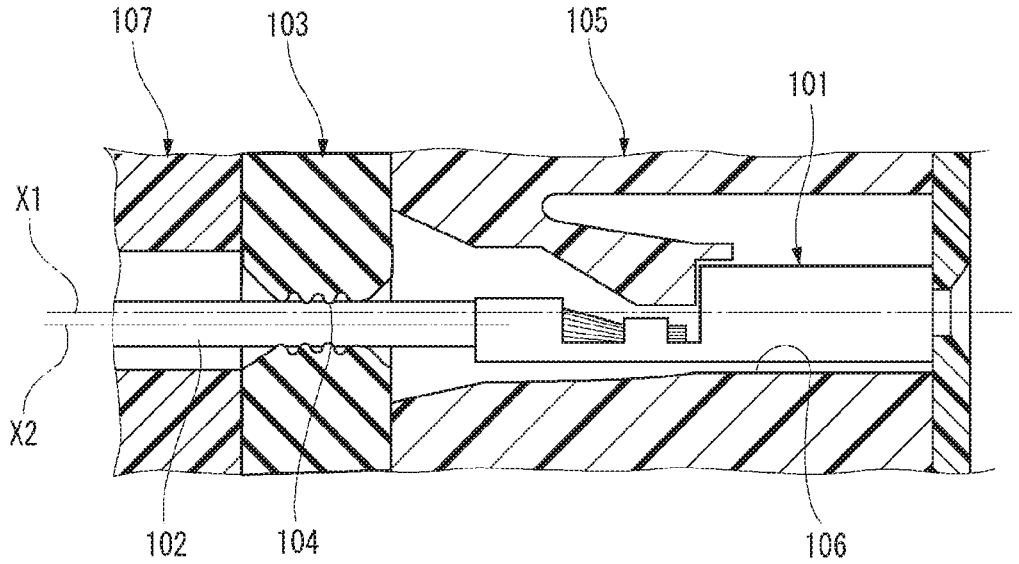

As illustrated in FIG. 9A, a terminal 101 to which a tab of a mating terminal is inserted and connected is configured such that a connection axis X1 and an axis X2 of an electric wire 102 are slightly deviated. Therefore, an insertion hole 104 of a mat seal (waterproofing member) 103 disposed to be matched up with the axis X2 of the electric wire 102 is slightly deviated from the center position of a through hole 108 of a mat seal cover (waterproofing member cover) 107 which guides the terminal 101 toward a terminal accommodating chamber 106 of a housing 105 and the terminal accommodating chamber 106.

Figure 9B:
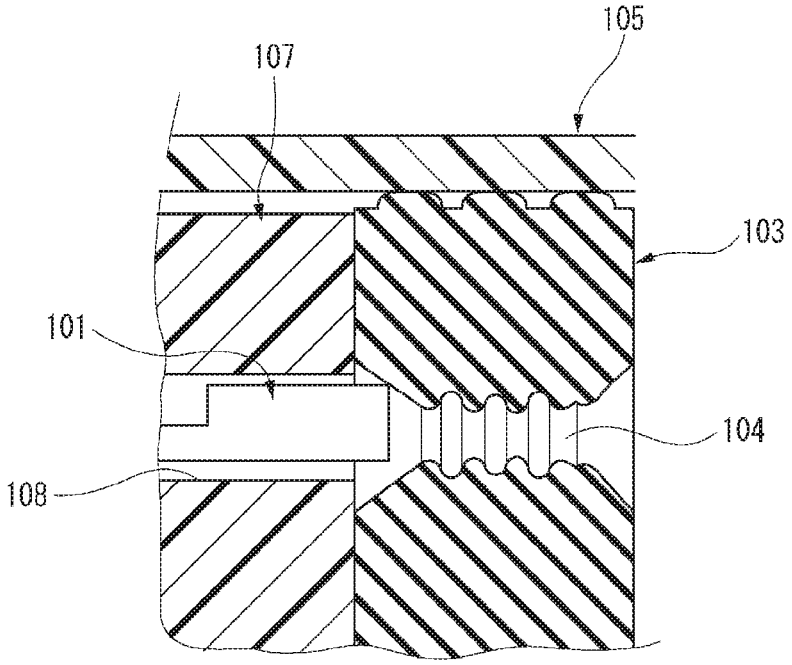

For this reason, as illustrated in FIG. 9B, the terminal 101 abuts on a position shifted from the edge of the insertion hole 104 of the mat seal 103 to partially cause a large load when the terminal 101 is inserted into the through hole 108 of the mat seal cover 107 and pressed into the insertion hole 104 of the mat seal 103 in order to store the terminal 101 into the terminal accommodating chamber 106 of the housing 105. Therefore, there is a concern that the mat seal 103 is damaged.

The invention has been made in view of the problem, and an object thereof is to provide a connector with which a terminal can be smoothly mounted without damage on the waterproofing member so as to improve reliability of a sealing performance.

Hereinafter, embodiments of a connector according to the invention will be described with reference to the drawings.

Figure 1:
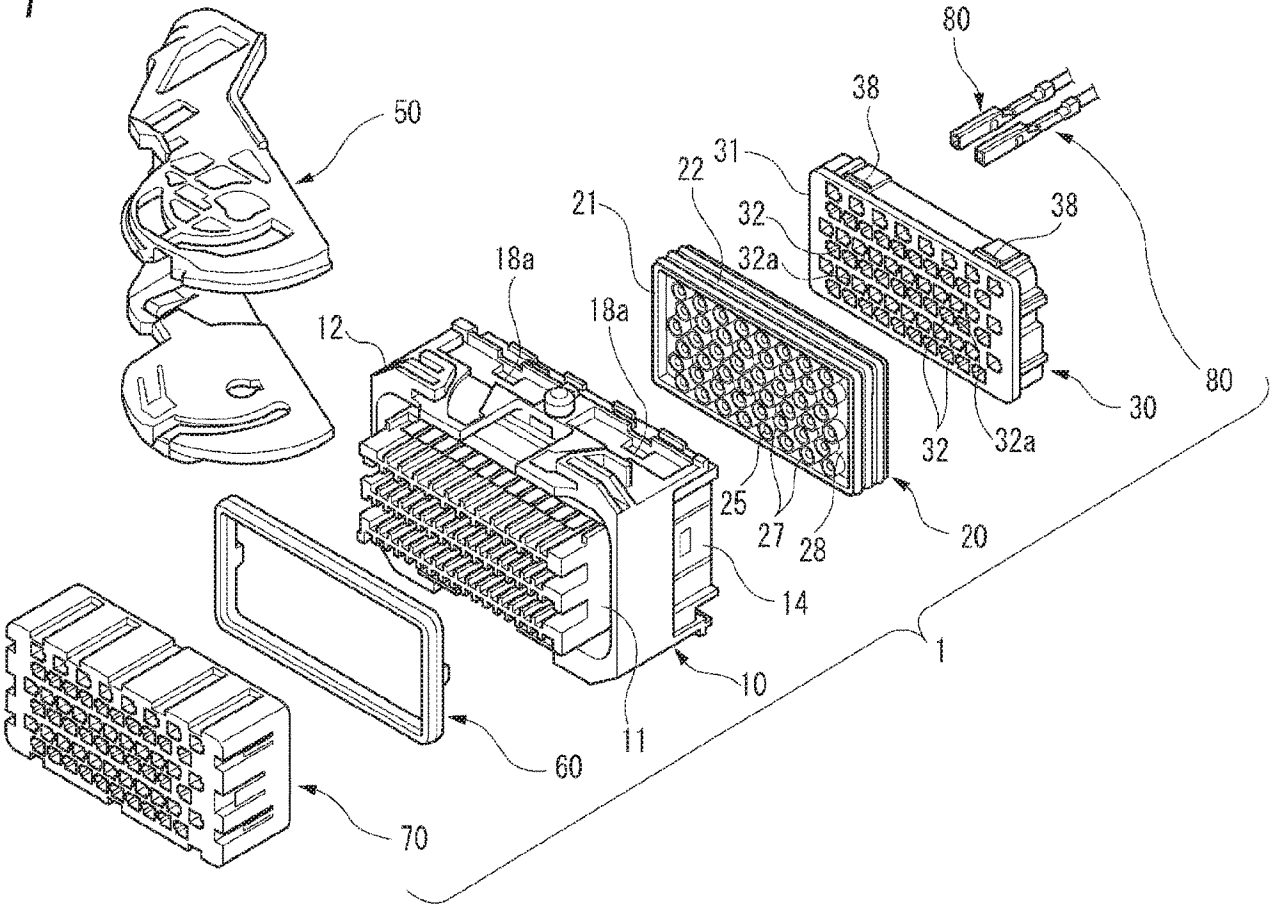
FIG. 1 is an exploded perspective view of a connector according to an embodiment of the invention.

FIG. 1 is an exploded perspective view of a connector 1 according to an embodiment of the invention.

As illustrated in FIG. 1, the connector 1 according to the embodiment includes a synthetic resin housing 10, a rubber or flexible resin mat seal (waterproofing member) 20 which is fitted to the rear portion of the housing 10, a synthetic resin mat seal cover (waterproofing member cover) 30 which is fitted and fixed to the rear portion of the housing 10 to prevent falling from the rear side of the mat seal 20 while pressing, a synthetic resin lever 50 which is rotatably mounted on the outer side of the housing 10, a packing 60 which is mounted in the housing 10 from the front side, a front holder 70 which is mounted in the front portion of the housing 10, and a plurality of female terminals (terminals) 80 which are stored in the housing 10 from the rear side.

The connector 1 is a waterproofing connector which seals a gap between an electric wire 81 and the housing 10 by the mat seal 20 which is mounted in the rear portion of the housing 10. The connector 1 rotates the lever 50 which is rotatably mounted in the housing 10 to pull the housing of a mating connector to the housing 10. Therefore, the mating connector is joined to the connector 1 with a low insertion force. In this way, the connector 1 is a waterproofing connector, and serves as an LIF connector which joins the mating connector by an operation of the lever 50 with a low insertion force.

Figure 4:
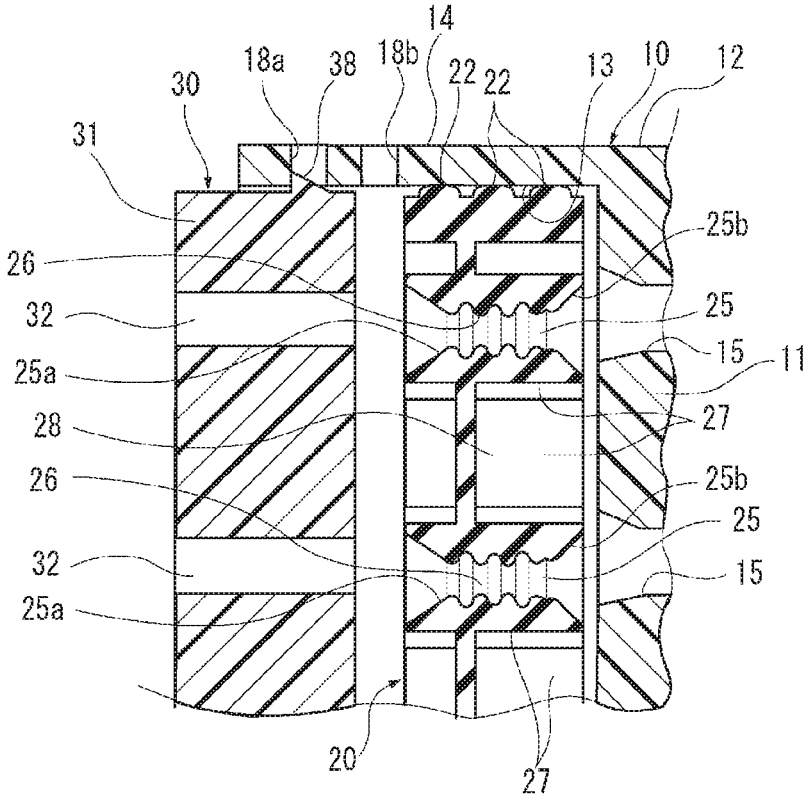
FIG. 4 is a cross-sectional view illustrating a temporary locking position between the mat seal mounted in a cylindrical wall of a housing and a mat seal cover.

As illustrated in FIGS. 1 and 4, the housing 10 includes an inner housing 11 on an inner peripheral side which includes a plurality of terminal accommodating chambers 15 storing the female terminals 80, an outer housing 12 on an outer peripheral side, and a cylindrical wall 14 which is disposed on a rear side of the inner housing 11 and the outer housing 12.

The terminal accommodating chamber 15 is formed in a rectangular shape in front view. The female terminal 80 having an electrical connection portion 82 of which the front end side is formed in a rectangular cylindrical shape, and in a rectangular shape in cross-sectional view is inserted and stored in the terminal accommodating chamber 15 in a predetermined posture.

The outer housing 12 is a portion to be locked to the outer periphery of a locking cylindrical wall of the housing of the mating connector (not illustrated). The inner housing 11 is a portion to be locked to the inner periphery of the locking cylindrical wall of the housing of the mating connector. The rear end of the outer housing 12 is bound to the rear end of the inner housing 11 and the front end of the cylindrical wall 14. The cylindrical wall 14 is formed with a storage space 13 to store the mat seal 20 and the mat seal cover 30.

Figure 2A:
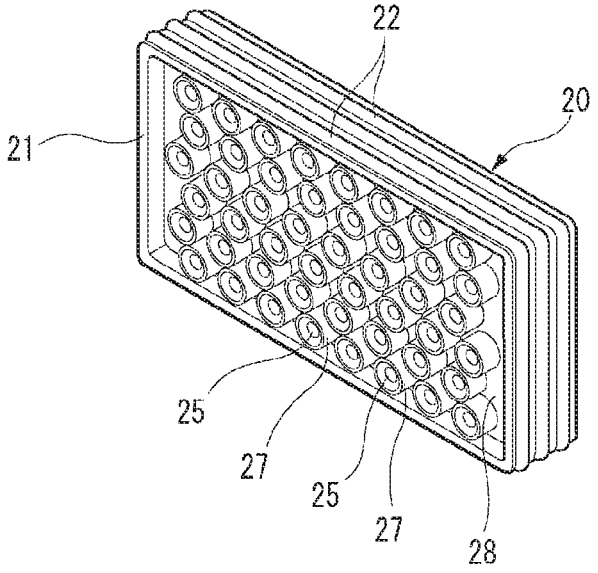
Figure 2B:
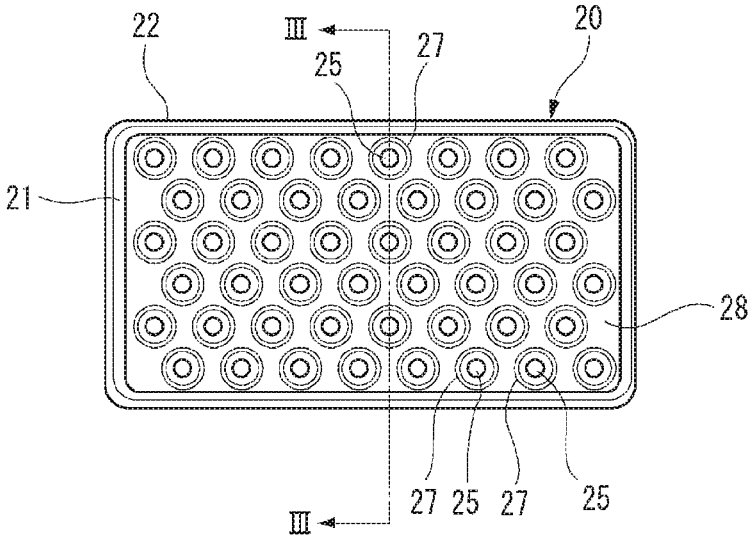
Figure 3:
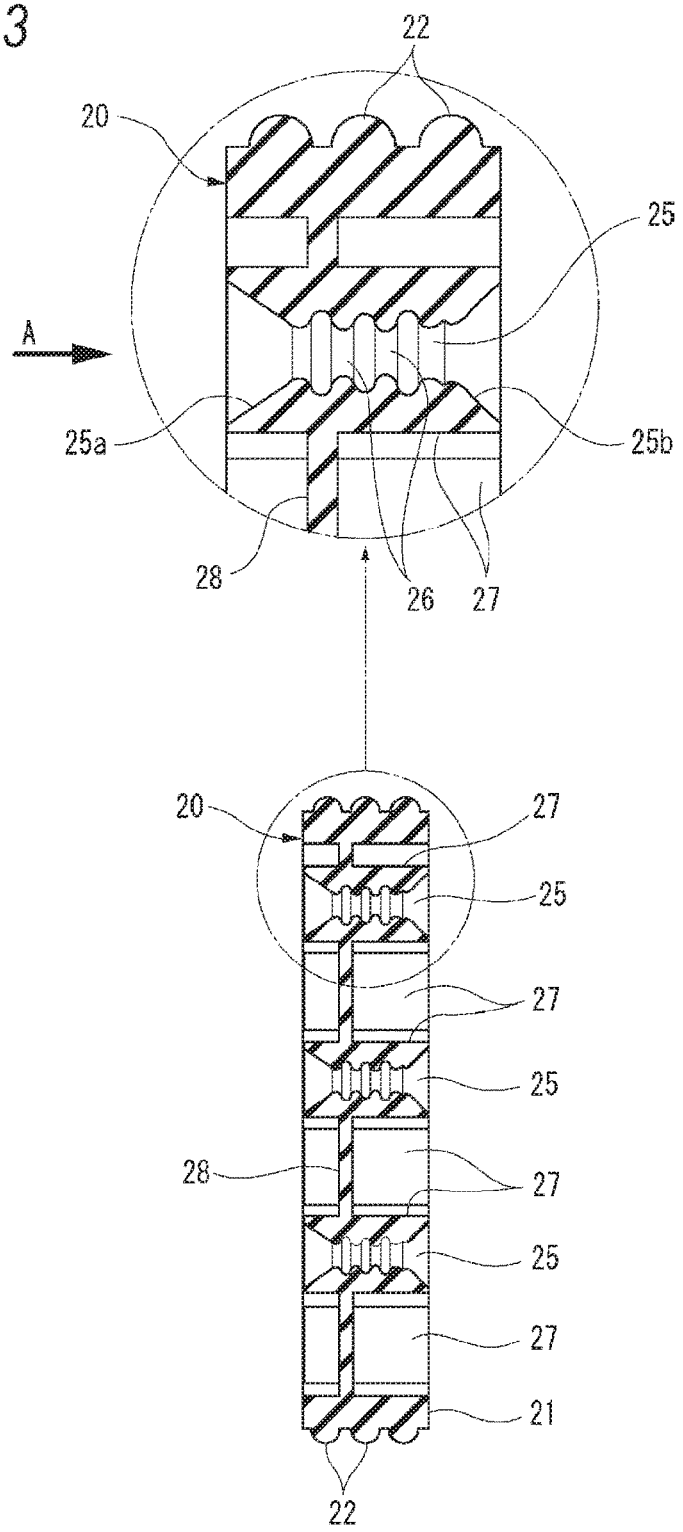
FIG. 3 is a cross-sectional view taken along line III-III in FIG. 2B and a partially enlarged view.

FIGS. 2A and 2B are views for describing the mat seal 20, in which FIG. 2A is a perspective view of the mat seal 20, and FIG. 2B is a front view of the mat seal 20. FIG. 3 is a cross-sectional view taken along line III-III in FIG. 2B and a partially enlarged view illustrating the portion.

As illustrated in FIGS. 2A and 2B, the mat seal 20 includes a lip 22 in the outer periphery of a mat body 21. The lip 22 seals a gap formed with respect to the cylindrical wall 14 when the mat body 21 is fitted to the inner periphery of the cylindrical wall 14 of the rear portion of the housing 10. Insertion holes 25 are formed to pass through the mat seal 20 at positions corresponding to the respective terminal accommodating chambers 15 of the housing 10 of the mat body 21. The mat seal 20 is configured such that the inner peripheries of the respective insertion holes 25 tightly adhere to the outer peripheries of the electric wires 81 extending from the respective female terminals 80 toward the rear side when the female terminals 80 are respectively inserted to the terminal accommodating chambers 15 through the insertion holes 25 in the state of being fitted to the inner periphery of the cylindrical wall 14 having the storage space 13 formed in the rear portion of the housing 10. Therefore, the electric wires 81 and the housing 10 are integrally sealed.

As illustrated in FIG. 3, the mat seal 20 includes a plurality of sealing portions 27 which are formed in a cylindrical shape. The sealing portion 27 is formed in a cylindrical shape having the insertion hole 25 through which the female terminal 80 is inserted in a terminal insertion direction A. In the inner surface of the insertion hole 25, a plurality of inner peripheral lips 26 protrude in an inner peripheral direction along the peripheral direction and are arranged with an interval in the axial direction. On the rear side and the front side of the terminal insertion direction A in the insertion hole 25, tapered guide portions 25*a* and 25*b* which face to the center in the axial direction of the insertion hole 25 and are tapered are formed. The insertion hole 25 having the inner peripheral lip 26 is expanded by the inserted female terminal 80, and tightly adheres to the outer periphery of the electric wire 81 after passing through the female terminal 80.

The mat seal 20 includes an elastically-deformable thin portion 28 between the plurality of sealing portions 27. The respective sealing portions 27 are connected to each other by the thin portion 28. The thin portion 28 is formed along a direction perpendicular to the terminal insertion direction A to the insertion hole 25, and is provided near the rear side of the terminal insertion direction A to the insertion hole 25 in the sealing portion 27. In the mat seal 20, since the elastically-deformable thin portion 28 is provided, weight W1 generated when the female terminal 80 guided to the insertion hole 25 by the guide portion 25*a* expands the insertion hole 25 is larger than weight W2 necessary for moving the sealing portion 27 in a direction perpendicular to the terminal insertion direction A when the female terminal 80 is inserted to the insertion hole 25. In other words, a relation of W1>W2 is established between the weight W1 generated when the female terminal 80 inserted in the insertion hole 25 expands the insertion hole 25 and the weight W2 necessary for moving the sealing portion 27 in a direction perpendicular to the terminal insertion direction A.

As illustrated in FIG. 1, the mat seal cover 30 is mounted to the rear end of the housing 10 through the mat seal 20 to perform a function of applying a pressing force to the mat seal 20 in order to prevent the mat seal 20 from being pulled off but held, and to exert a sufficient sealing performance. In a cover body 31 of the mat seal cover 30 which is made of a molded synthetic resin part, there are provided a plurality of through holes 32 at positions corresponding to the respective insertion holes 25 of the mat seal 20 to insert the female terminal 80 thereinto and to draw the electric wire 81 toward the rear side. The through hole 32 is formed in a rectangular shape in front view. The female terminal 80 having the electrical connection portion 82 formed in a rectangular cylindrical shape, and in a rectangular shape in cross-sectional view is inserted to the through hole 32. In the through hole 32, a positioning concave portion 32*a* is formed in a portion of the inner peripheral surface along the axial direction.

Figure 5:
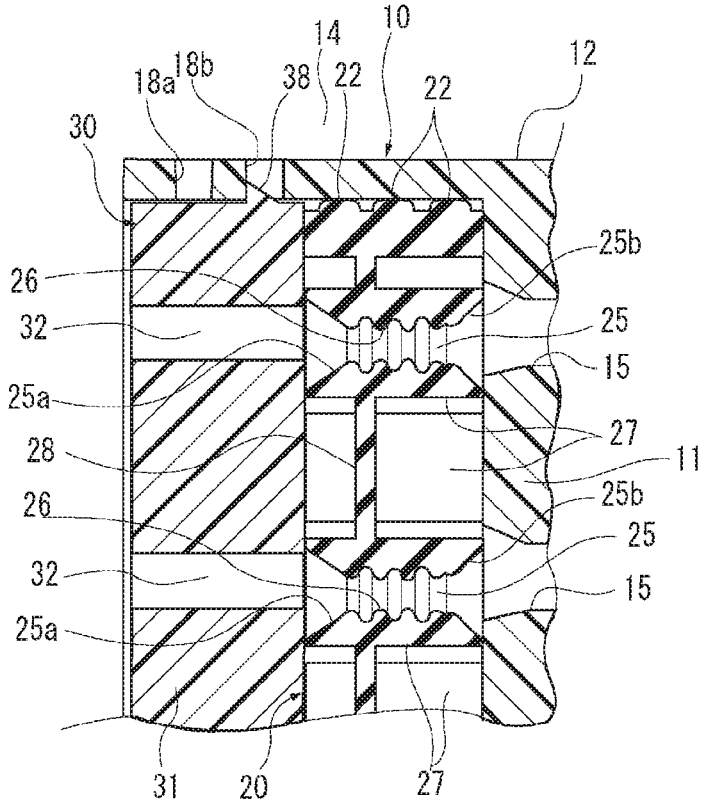
FIG. 5 is a cross-sectional view illustrating a final locking position between the mat seal mounted in the cylindrical wall of the housing and the mat seal cover.

FIG. 4 is a cross-sectional view illustrating a temporary locking position of the mat seal 20 mounted in the cylindrical wall 14 of the housing 10 and the mat seal cover 30. FIG. 5 is a cross-sectional view illustrating a final locking position of the mat seal 20 and the mat seal cover 30.

As illustrated in FIGS. 4 and 5, a locking portion 38 is formed in the periphery of the mat seal cover 30. The locking portion 38 is locked to a temporary locking hole 18*a* or a final locking hole 18*b* which are formed in the cylindrical wall 14 of the housing 10.

As illustrated in FIG. 4, the mat seal cover 30 is disposed at the temporary locking position with respect to the housing 10 when the locking portion 38 is locked to the temporary locking hole 18*a*. In this state, the mat seal 20 is held in the mat seal cover 30 while being stored in the storage space 13 of the housing 10 without being compressed and deformed in the mounting direction.

As illustrated in FIG. 5, the mat seal cover 30 is further pressed into the cylindrical wall 14 of the housing 10 from the temporary locking position and the locking portion 38 is locked to the final locking hole 18*b*, and thus the mat seal cover 30 is disposed at the final locking position with respect to the housing 10. When the mat seal cover 30 is disposed at the final locking position with respect to the housing 10, the mat seal 20 is pressed into the cylindrical wall 14 while being compressed and deformed in the mounting direction. With this configuration, the outer peripheral portion of the mat seal 20 is enlarged and the lip 22 is pressed to the inner peripheral surface of the cylindrical wall 14, and also the insertion hole 25 of the sealing portion 27 is shrunk and the inner peripheral lip 26 is pressed to the outer peripheral surface of the electric wire 81. Therefore, it is possible for the mat seal 20 to exert a sufficient sealing performance.

Figure 6A:
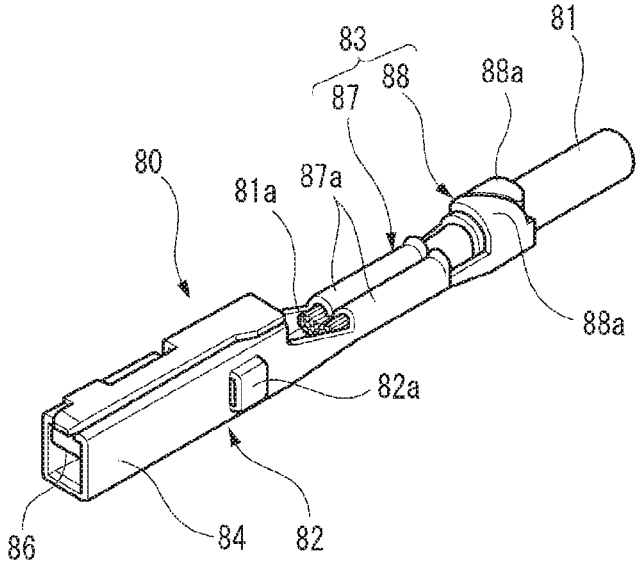
Figure 6B:
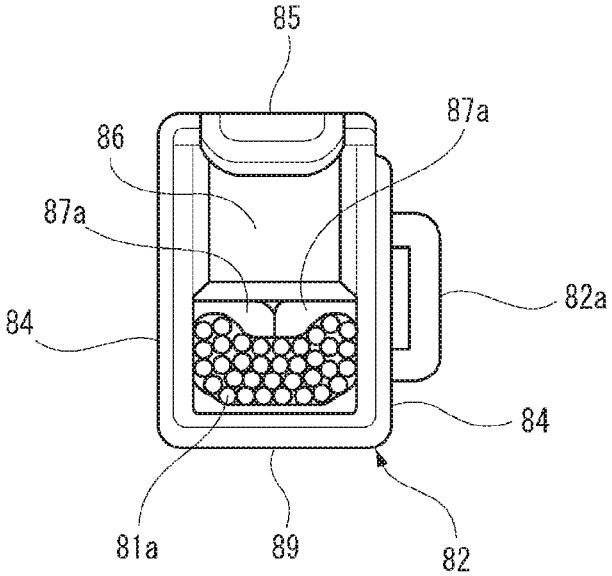

FIGS. 6A and 6B are views for describing a structure of the female terminal 80, in which FIG. 6A is a perspective view of the female terminal 80, and FIG. 6B is a front view of the female terminal 80.

As illustrated in FIGS. 6A and 6B, the electric wire 81 is connected to the female terminal 80. The female terminal 80 includes the electrical connection portion 82 and an electric wire connecting portion 83. The female terminal 80 is formed of a conductive metallic material such as copper or a copper alloy, and thus is formed by punching and bending in press molding.

The electrical connection portion 82 is formed in a rectangular cylindrical shape which is a rectangular shape in cross-sectional view. The electrical connection portion 82 includes a bottom plate 89, side plates 84 which are erected from the both side portions of the bottom plate 89, and a top plate 85 which is provided to extend from the upper edge of one side plate 84 to the upper edge of the other side plate 84. In the top plate 85, an elastic contact piece 86 is formed. The elastic contact piece 86 is folded back inside on the front end side in the top plate 85 to extend toward the rear end side. The intermediate portion of the elastic contact piece 86 is bent to be projected toward the bottom plate 89 side. A slight gap is formed between the bottom plate 89 and the elastic contact piece 86. A male terminal (not illustrated) of the mating connector is inserted between the bottom plate 89 and the elastic contact piece 86 in the electrical connection portion 82, and thus the female terminal 80 and the mating male terminal are electrically connected to each other. The electrical connection portion 82 includes a positioning projection 82*a* in one side portion which protrudes to the outside. The positioning projection 82*a* is inserted and fitted to the positioning concave portion 32*a* which is formed in the through hole 32 of the mat seal cover 30. With this configuration, the female terminal 80 is inserted to the through hole 32 of the mat seal cover 30 in a state of being positioned in a predetermined posture, and sent to the mat seal 20 and the housing 10.

The electric wire connecting portion 83 of the female terminal 80 includes a conductor crimping portion 87 and a sheath crimping portion 88 sequentially from the electrical connection portion 82 side. The conductor crimping portion 87 includes a pair of conductor caulking pieces 87*a*. The sheath crimping portion 88 includes a pair of sheath caulking pieces 88*a*. In the conductor crimping portion 87, a conductor 81*a* exposed at the end portion of the electric wire 81 is pressed by caulking the conductor caulking piece 87*a*. Therefore, the female terminal 80 is electrically connected to the conductor 81*a* of the electric wire 81. In the sheath crimping portion 88, the end portion of the sheath of the electric wire 81 is compressed and fixed by caulking the sheath caulking piece 88*a*.

Figure 7:
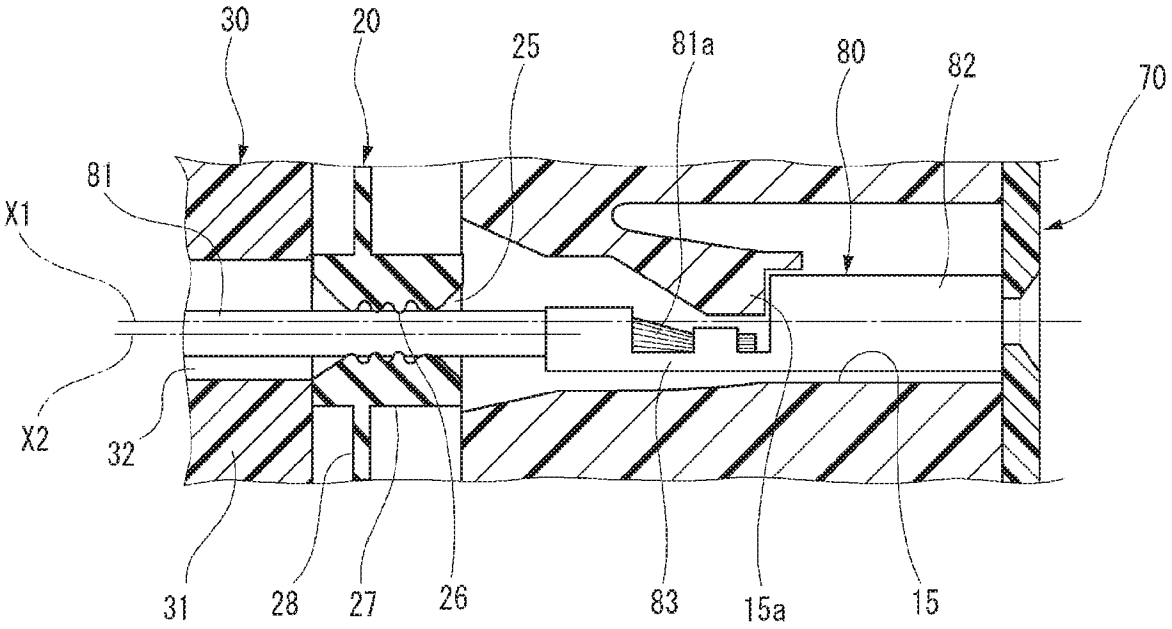
FIG. 7 is a cross-sectional view illustrating a part of a connector for describing a storage state of the terminal.

FIG. 7 is a cross-sectional view illustrating a part of the connector 1 for describing a storage state of the female terminal 80.

As illustrated in FIG. 7, the female terminal 80 mounted from the rear end of the connector 1 is stored in a state where the electrical connection portion 82 is locked by a lance 15*a* in the terminal accommodating chamber 15 of the housing 10. In this state, the inner peripheral lip 26 of the insertion hole 25 of the mat seal 20 tightly adheres to the outer periphery of the electric wire 81 connected to the female terminal 80, and thus a gap between the electric wire 81 and the housing 10 is sealed.

By the way, a connection axis X1 of the female terminal 80 with respect to a mating terminal in the electrical connection portion 82 is slightly deviated from an axis X2 of the electric wire 81. The insertion hole 25 of the mat seal 20 is disposed such that the center position thereof is matched up with the axis X2 of the electric wire 81. Therefore, the center position of the insertion hole 25 of the mat seal 20 is slightly deviated from the center position of the terminal accommodating chamber 15 of the housing 10 and the center position of the through hole 32 of the mat seal cover 30 which guides the female terminal 80 to the terminal accommodating chamber 15. With this configuration, in a state where the female terminal 80 is stored in the terminal accommodating chamber 15 of the housing 10, the electric wire 81 connected to the female terminal 80 is inserted through the center of the insertion hole 25 of the mat seal 20, and the inner peripheral lip 26 of the insertion hole 25 of the mat seal 20 evenly and tightly adheres to the electric wire 81 so as to secure good sealing.

Next, the description will be given about a case where the female terminal 80 is assembled to the housing 10.

Figure 8B:
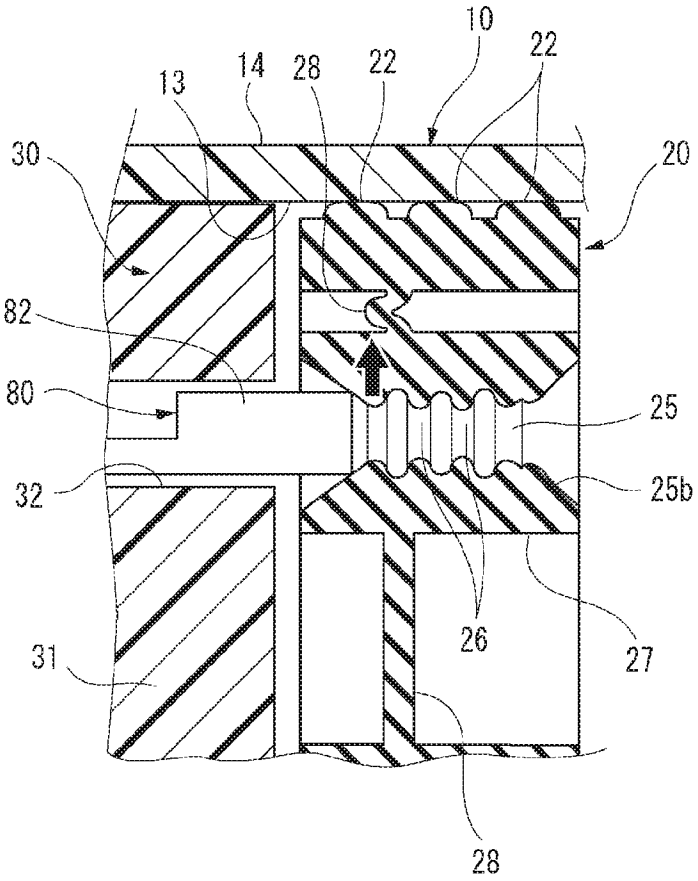
Figure 8A:
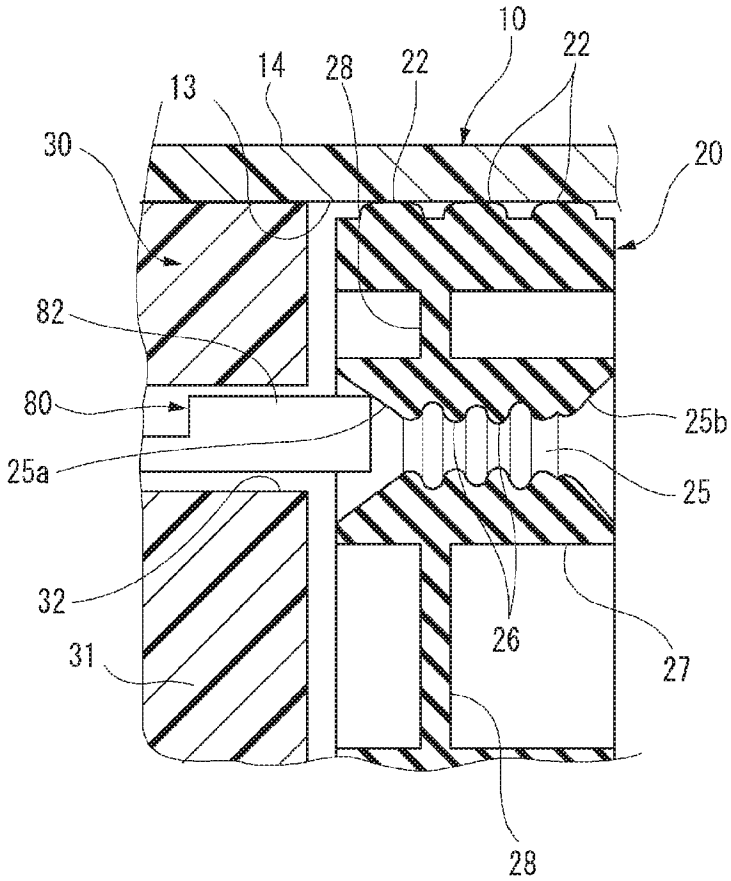

FIGS. 8A and 8B are views illustrating a state of the mat seal 20 when the female terminal 80 is inserted to the insertion hole, in which FIGS. 8A and 8B are cross-sectional views of the mat seal 20 and the mat seal cover 30 respectively.

As illustrated in FIG. 8A, the position of the positioning projection 82*a* formed in the electrical connection portion 82 of the female terminal 80 is arranged to be matched up with the positioning concave portion 32*a* of the through hole 32 of the mat seal cover 30, and the female 80 is inserted into the through hole 32 from the rear side of the mat seal cover 30. With this configuration, the female terminal 80 is inserted through the through hole 32 of the mat seal cover 30 in a predetermined posture. At this time, the mat seal cover 30 holding the mat seal 20 in the housing 10 is set in the state of being temporarily locked to the housing 10 by the temporary locking position.

As illustrated in FIG. 8B, the electrical connection portion 82 of the female terminal 80 is inserted to the insertion hole 25 of the mat seal 20 by further inserting the female terminal 80. At this time, the center position of the insertion hole 25 of the mat seal 20 is slightly deviated from the center position of the through hole 32 of the mat seal cover 30 which guides the female terminal 80 to the terminal accommodating chamber 15 of the housing 10. Therefore, the electrical connection portion 82 of the female terminal 80 abuts on the position shifted from the guide portion 25*a* of the insertion hole 25 of the mat seal 20. Then, the weight W1 generated when the female terminal 80 expands the insertion hole 25 is applied to the sealing portion 27. The weight W1 generated when the female terminal 80 expands the insertion hole 25 is larger than the weight W2 necessary for moving the sealing portion 27 in a direction perpendicular to the terminal insertion direction A. Therefore, the thin portion 28 of the mat seal 20 is elastically deformed, and thus the center position of the insertion hole 25 is displaced to the same position as the connection axis X1 of the electrical connection portion 82. Thereafter, the female terminal 80 is inserted into the insertion hole 25 without hardship while expanding the displaced insertion hole 25 of the mat seal 20.

When the female terminal 80 passes through the insertion hole 25 of the mat seal 20, the weight W1 generated when the female terminal 80 expands the insertion hole 25 disappears, the elastically-deformed thin portion 28 is recovered, the center position of the insertion hole 25 becomes matched up with the axis X2 of the electric wire 81, and the inner peripheral lip 26 of the insertion hole 25 of the mat seal 20 evenly and tightly adheres to the outer peripheral surface of the electric wire 81.

After all the female terminals 80 are stored in the terminal accommodating chamber 15 of the housing 10, the mat seal cover 30 disposed in the temporary locking position with respect to the housing 10 is pressed toward the housing 10 side to be moved to the final locking position with respect to the housing 10. Then, the mat seal 20 is further pressed into the cylindrical wall 14 of the housing 10, and compressed and deformed in the mounting direction. Accordingly, the outer peripheral portion of the mat seal 20 is enlarged, and the lip 22 securely and tightly adheres to the inner peripheral surface of the cylindrical wall 14. In addition, the insertion hole 25 of each sealing portion 27 is shrunk, and the inner peripheral lip 26 securely and tightly adheres to the outer peripheral surface of the electric wire 81. Thus, the sealing performance is increased.

Even when the female terminal 80 is removed from the connector 1, the electrical connection portion 82 of the female terminal 80 abuts on the position shifted from the guide portion 25*b* of the insertion hole 25 of the mat seal 20. Then, the thin portion 28 of the mat seal 20 is elastically deformed by the weight W1 generated when the female terminal 80 expands the insertion hole 25, and thus the center position of the insertion hole 25 is displaced to the same position as the connection axis X1 of the electrical connection portion 82. Thereafter, the female terminal 80 is removed from the insertion hole 25 without hardship while expanding the displaced insertion hole 25 of the mat seal 20.

Hitherto, as described above, according to the connector 1 of the embodiment, the thin portion 28 is provided in the vicinity of the sealing portion 27. The thin portion 28 is formed such that the weight W1 generated when the female terminal 80 expands the insertion hole 25 becomes larger than the weight W2 necessary for moving the sealing portion 27 in a direction perpendicular to the terminal insertion direction A. Therefore, even when the center of the insertion hole 25 of the sealing portion 27 of the mat seal 20 is deviated from the center of the terminal accommodating chamber 15 of the housing 10 and the center of the through hole 32 of the mat seal cover 30 because the connection axis X1 of the female terminal 80 is deviated from the axis X2 of the electric wire 81, the sealing portion 27 surrounded by the elastically-deformable thin portion 28 can be easily displaced in a direction perpendicular to the terminal insertion direction A by the weight W1 generated when the female terminal 80 guided to the insertion hole 25 by the guide portion 25*a* expands the insertion hole 25. Therefore, even if the female terminal 80 abuts on the position shifted in the edge of the insertion hole 25 of the mat seal 20 when the female terminal 80 is pressed into the insertion hole 25 of the mat seal 20, the female terminal 80 can be smoothly inserted to and passed through the insertion hole 25 without any damage partially on the mat seal 20 caused by a large load. Further, it is possible to improve reliability in the sealing performance between the housing 10 and the electric wire 81.

According to this embodiment, the female terminal 80 is smoothly inserted to the insertion hole 25 of the mat seal 20 in a state where the mat seal 20 is not compressed and deformed in the mounting direction, so that the female terminal 80 can be stored in the terminal accommodating chamber 15 of the housing 10. Further, the mat seal cover 30 is moved from the temporary locking position to the final locking position to compress and deform the mat seal 20 in the mounting direction after the female terminal 80 is stored in the terminal accommodating chamber 15 of the housing 10. Thus, the outer peripheral portion of the mat seal 20 is enlarged, and the lip 22 securely and tightly adheres to the inner peripheral surface of the cylindrical wall 14. In addition, the insertion hole 25 of each sealing portion 27 is shrunk, and the inner peripheral lip 26 of the insertion hole 25 securely and tightly adheres to the outer peripheral surface of the electric wire 81, so that it is possible to improve the sealing performance.

Furthermore, even if a load is applied on the end portion of the insertion side in the sealing portion 27 when the female terminal 80 is inserted to the insertion hole 25, it is possible to extremely prevent the inclining of the sealing portion 27 and a large deformation of the mat seal 20, and the female terminal 80 can be smoothly inserted to the insertion hole 25 since the thin portion 28 is formed near the rear side of the terminal insertion direction A in the sealing portion 27.

Further, the invention is not limited to the above embodiments, and modifications and improvements can be appropriately made. Besides, materials, shapes, dimensions, numbers, and layout places of the respective components in the above embodiments are arbitrary and not limited as long as the invention can be achieved.

Herein, the features of the embodiments of the connector according to the invention will be simply summarized in the following [1] to [3].

[1] A connector (1), including:

a terminal (female terminal 80) connected to an end of an electric wire (81);

a housing (10) including a terminal accommodating chamber (15) to which the terminal (female terminal 80) is inserted from a rear side;

a waterproofing member (mat seal 20) including an insertion hole (25) through which the terminal (female terminal 80) passes, and mounted on a rear side of the housing (10) to seal a gap between the housing (10) and the electric wire (81) extending from the terminal (female terminal 80) passes through the insertion hole (25); and a waterproofing member cover (mat seal cover 30) including a through hole (32) through which the terminal (female terminal 80) passes, holding the waterproofing member (mat seal 20) in the housing (10), and configured to guide the terminal (female terminal 80) to be inserted to the through hole (32) toward the terminal accommodating chamber (15), wherein the waterproofing member (mat seal 20) includes a cylindrical sealing portion (27) in which the insertion hole (25) is formed, and a guide portion (25*a*) at least on a rear side in a terminal insertion direction (A) in the insertion hole (25) of the sealing portion (27) and having a tapered shape so as to guide the terminal (female terminal 80) toward the insertion hole (25), and the waterproofing member (mat seal 20) includes an elastically-deformable thin portion (28) is provided in the periphery of the sealing portion (27) so that weight (W1) generated when the terminal (female terminal 80) guided to the insertion hole (25) by the guide portion (25*a*) expands the insertion hole (25) is larger than weight (W2) necessary for moving the sealing portion (27) in a direction perpendicular to the terminal insertion direction (A).

[2] The connector according to [1], wherein the housing (10) includes a cylindrical wall (14) which forms a storage space (13) storing the waterproofing member (mat seal 20) and the waterproofing member cover (mat seal cover 30), and the waterproofing member cover (mat seal cover 30) is configured to be moved, from a temporary locking position where the waterproofing member (mat seal 20) is mounted in the storage space (13) so as to be prevented from being pulled off without being compressed and deformed in a mounting direction, to a final locking position where the waterproofing member (mat seal 20) is compressed and deformed in the mounting direction.

[3] The connector according to [1] or [2], wherein the thin portion (28) is disposed near a rear side of the terminal insertion direction (A) in the sealing portion (27).

According to the connector, even though the center of the insertion hole of the sealing portion of the waterproofing member is deviated from the terminal accommodating chamber of the housing and the center of the through hole of the waterproofing member cover due to the deviation between the connection axis of the terminal and the axis of the electric wire, the sealing portion surrounded by the elastically-deformable thin portion can be easily displaced in a direction perpendicular to the terminal insertion direction at the weight generated when the terminal guided to the insertion hole by the guide portion expands the insertion hole. Then, even if the terminal abuts on the position shifted from the edge of the insertion hole of the waterproofing member when the terminal is pressed into the insertion hole of the waterproofing member, the terminal can be smoothly inserted to and pass through the insertion hole without any damage on the waterproofing member due to a large load partially applied thereon, and the reliability in the sealing performance between the housing and the electric wire can be improved.

According to the connector, in a state where the waterproofing member is compressed and deformed in the mounting direction, the terminal can be smoothly inserted to the insertion hole of the waterproofing member to be stored in the terminal accommodating chamber of the housing. Further, the waterproofing member cover is moved from the temporary locking position to the final locking position to compressed and deform the waterproofing member in the mounting direction after the terminal is stored in the terminal accommodating chamber of the housing. Therefore, the outer peripheral portion of the waterproofing member is enlarged to securely and tightly adhere to the inner peripheral surface of the cylindrical wall, and the insertion hole of each sealing portion is shrunk to securely and tightly adhere to the outer peripheral surface of the electric wire, so that the sealing performance can be improved.

According to the connector, even if a load is applied to an end on the insertion side in the sealing portion when the terminal is inserted to the insertion hole, it is possible to extremely suppress the inclining of the sealing portion and a large deformation of the waterproofing member, and the terminal can be smoothly inserted to the insertion hole since the thin portion is formed near the rear side of the terminal insertion direction in the sealing portion.

According to the invention, it is possible to provide a connector which can smoothly mount a terminal without damage on the waterproofing member to improve reliability in a sealing performance.

What is claimed is:

1. A connector comprising:

a terminal connected to an end of an electric wire;

a housing including a terminal accommodating chamber to which the terminal is inserted from a rear side;

a waterproofing member including an insertion hole through which the terminal passes, and mounted on a rear side of the housing to seal a gap between the housing and the electric wire extending from the terminal passed through the insertion hole; and a waterproofing member cover including a through hole through which the terminal passes, holding the waterproofing member in the housing, and configured to guide the terminal to be inserted to the through hole toward the terminal accommodating chamber, wherein the waterproofing member includes a cylindrical sealing portion in which the insertion hole is formed, and a guide portion disposed at least on a rear side in a terminal insertion direction in the insertion hole of the sealing portion and having a tapered shape so as to guide the terminal toward the insertion hole, and the waterproofing member includes an elastically-deformable thin portion in a periphery of the sealing portion so that weight generated when the terminal guided to the insertion hole by the guide portion expands the insertion hole is larger than weight necessary for moving the sealing portion in a direction perpendicular to the terminal insertion direction.

2. The connector according to claim 1, wherein the housing includes a cylindrical wall which forms a storage space storing the waterproofing member and the waterproofing member cover, and the waterproofing member cover is configured to be moved, from a temporary locking position where the waterproofing member is mounted in the storage space so as to be prevented from being pulled off without being compressed and deformed in a mounting direction, to a final locking position where the waterproofing member is compressed and deformed in the mounting direction.

3. The connector according to claim 1, wherein the thin portion is disposed near a rear side of the terminal insertion direction in the sealing portion.

* * * * *